US011619898B2

(12) United States Patent
Koizumi et al.

(10) Patent No.: US 11,619,898 B2
(45) Date of Patent: Apr. 4, 2023

(54) IMAGE FORMING APPARATUS FOR CONTROLLING TRANSFER VOLTAGE BASED ON PATTERN

(71) Applicant: CANON KABUSHIKI KAISHA, Tokyo (JP)

(72) Inventors: Kazuhisa Koizumi, Chiba (JP); Keisuke Kitajima, Chiba (JP); Tetsuhiro Yoshimoto, Tokyo (JP); Hironobu Konno, Ibaraki (JP); Takeyuki Suda, Chiba (JP); Takaaki Doshida, Chiba (JP); Shinichi Isozaki, Saitama (JP); Ryo Mikami, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/588,664

(22) Filed: Jan. 31, 2022

(65) Prior Publication Data

US 2022/0253010 A1 Aug. 11, 2022

(30) Foreign Application Priority Data

Feb. 5, 2021 (JP) ..... JP2021-017742

(51) Int. Cl.
*G03G 15/00* (2006.01)
*G03G 15/01* (2006.01)

(52) U.S. Cl.
CPC ..... *G03G 15/5058* (2013.01); *G03G 15/0121* (2013.01); *G03G 15/0131* (2013.01); *G03G 15/5041* (2013.01)

(58) Field of Classification Search
CPC ..... G03G 15/5058; G03G 15/0121; G03G 15/0131; G03G 15/5041; G03G 15/5062; G03G 15/1675
See application file for complete search history.

(56) References Cited

U.S. PATENT DOCUMENTS

| | | | | |
|---|---|---|---|---|
| 8,526,835 | B2 | 9/2013 | Lee et al. | |
| 10,712,683 | B1 * | 7/2020 | Miyakoshi | G03G 15/5062 |
| 2017/0097593 | A1 * | 4/2017 | Itagaki | G03G 15/1675 |

FOREIGN PATENT DOCUMENTS

JP 5840992 B2 1/2016

* cited by examiner

*Primary Examiner* — Sandra Brase
(74) *Attorney, Agent, or Firm* — Venable LLP

(57) ABSTRACT

An image forming unit forms test images of a color of the same type as a first color using toner of a second color and toner of a third color, transfers first and second test images, fixes the test images on a sheet, controls a sensor to read the test images, determines sampling timings for the test images based on an output signal related to the first test image outputted from the sensor using a color filter of a fourth color, acquires a result of reading the test images based on a reading result of the test images on the sheet by the color sensor using a color filter of the first color and the sampling timing, and determines a transfer voltage based on the result of reading the test images.

14 Claims, 8 Drawing Sheets

FIG. 7

| PATTERN NUMBER | TRANSFER VOLTAGE [V] | DENSITY DATA |
|---|---|---|
| i | 100 | 160 |
| ii | 150 | 120 |
| iii | 200 | 135 |
| iv | 250 | 140 |

IMAGE FORMING APPARATUS FOR CONTROLLING TRANSFER VOLTAGE BASED ON PATTERN

BACKGROUND OF THE INVENTION

Field of the Invention

The present invention relates to an image forming apparatus, specifically an image forming apparatus for controlling a transfer voltage based on a pattern.

Description of the Related Art

Image forming apparatuses form a toner image on an image bearing member based on image data of a document and transfer the toner image from the an image bearing member to a sheet. In order for the toner image to be efficiently transferred, a transfer voltage is applied to a transfer roller. An appropriate value for this transfer voltage varies according to a type of sheet (e.g., surface property, thickness, grammage) and environmental conditions (e.g., temperature, humidity). Therefore, image forming apparatuses form a test pattern on a sheet, read it with an RGB sensor, and determine an appropriate value for the transfer voltage (Japanese Patent No. 5840992). RGB is an abbreviation for red, green, and blue, which are three primary colors of light.

Image forming apparatuses form a color image by superimposing a yellow (Y) toner image, a magenta (M) toner image, a cyan (C) toner image, and a black (K) toner image one over another. In other words, various color images are reproduced by mixing colors of YMCK toners. Among such color images, a monochromatic black (K) image and a blue (B) (a mixed color consisting of magenta (M) and cyan (C)) image are easier to visually confirm density failure with and, therefore, may be formed on a sheet as a test image. Since RGB-type image sensors are prevalent, image forming apparatuses read test images with such an image sensor as an RGB-type image sensor. In particular, image forming apparatuses read a test image while conveying a sheet. Here, in order to increase a speed of reading a test image as well as reduce memory, it is necessary to accurately detect that a leading end of a test image formed on a sheet has arrived at a reading position of an image sensor and read an appropriate range of the test image. Here, in order to adjust a transfer voltage, a test image formed using a plurality of toners is used. When reading a blue (B) test image, for example, it is common to use a read signal corresponding to light reflected off of a blue (B) component. This is because when a blue test image is read, a dynamic range of a blue read signal value is larger than dynamic ranges of read signal values of other color components. However, depending on the state of a sheet and the state of an image forming apparatus, when a blue (B) read signal value is used, there may be cases where it may be difficult to accurately detect that a blue (B) test image has arrived at a reading position.

SUMMARY OF THE INVENTION

The present invention may provide an image forming apparatus comprising an image bearing member; an image forming unit configured to form an image on the image bearing member, the image forming unit including a first developing device configured to develop a yellow image by using yellow toner; a second developing device configured to develop a magenta image by using magenta toner; and a third developing device configured to develop a cyan image by using cyan toner; a transfer unit configured to transfer the image on the image bearing member to a sheet based on a transfer voltage; a fixing unit configured to fix the image on the sheet; a color sensor configured to read image on the sheet while the sheet is being conveyed, the color sensor having a red color filter, a blue color filter, and a green color filter; and a controller configured to control the image forming unit to form test images of a color of the same type as a first color among red, blue, and green using toner of a second color among yellow, magenta, and cyan, and toner of a third color among yellow, magenta, or cyan; control the transfer unit to transfer a first test image included in the test images based on a first transfer voltage, and transfer a second test image included in the test images based on a second transfer voltage different from the first transfer voltage; control the fixing unit to fix the test images on a sheet; control the color sensor to read image on the sheet having the test images thereon; determine sampling timings for the test images on the sheet based on an output signal related to the first test image on the sheet outputted from the color sensor using a color filter of a fourth color among red, blue, and green; acquire a result of reading the test images based on a reading result of the test images on the sheet by the color sensor using a color filter of the first color, and the sampling timings; and determine the transfer voltage based on the result of reading the test images.

Further features of the present invention will become apparent from the following description of exemplary embodiments (with reference to the attached drawings).

BRIEF DESCRIPTION OF THE DRAWINGS

FIG. 7 is a diagram for explaining pattern numbers, transfer voltages, and density data.

DESCRIPTION OF THE EMBODIMENTS

Figure 1:
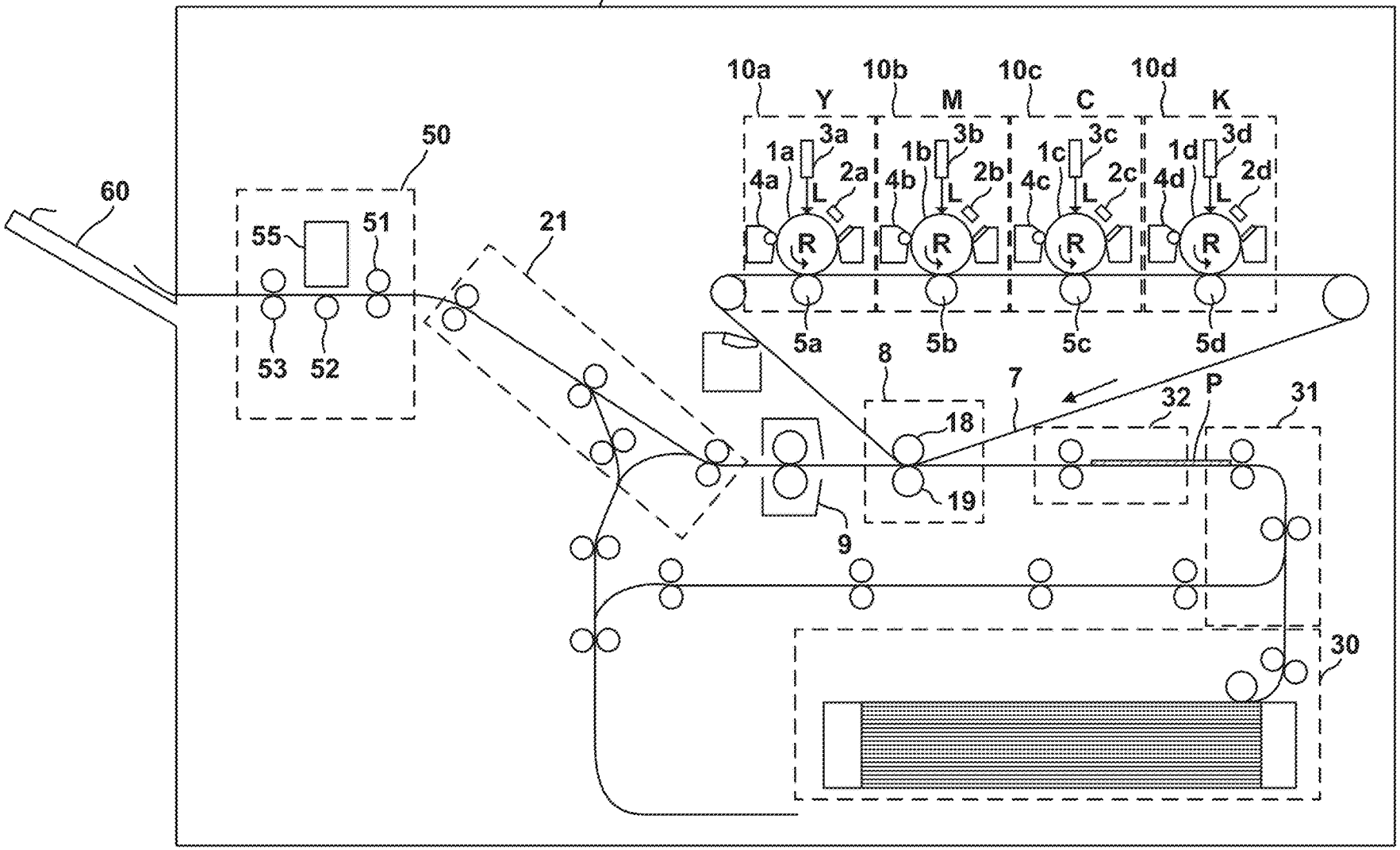
FIG. 1 is a diagram for explaining an image forming apparatus.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

First Embodiment

Image Forming Apparatus

FIG. 1 illustrates an image forming apparatus 100 having an image reading apparatus 50. Four image forming stations 10*a* to 10*d* respectively form toner images of yellow (Y), magenta (M), cyan (C), and black (K). Since internal structures of the image forming stations 10*a* to 10*d* are identical or similar, the structure of the image forming station 10*a* will now be described as a representative example. That is, the description of the image forming station 10*a* is referenced as a description of the image forming stations 10*b* to 10*d*. In the following, the same reference numerals are given to a plurality of objects having the same or a similar structure. When matters common to a plurality of objects are described, lowercase alphabet letters added to reference numerals may be omitted.

A photosensitive drum 1*a* is a cylindrical photosensitive member and rotates in a direction of an arrow R. A primary charging device 2*a* is a charging roller or a charging member that uniformly charges the surface of the photosensitive drum 1*a*. An exposure device 3*a* is an optical scanning apparatus that forms an electrostatic latent image by scanning the surface of the photosensitive drum 1*a* with light corresponding to an image signal. A developing device 4*a* develops an electrostatic latent image using toner to form a toner image. A primary transfer roller 5*a* transfers a yellow toner image to an intermediate transfer member 7. The intermediate transfer member 7 functions as an image bearing member. A primary transfer roller 5*b* transfers a magenta toner image to the intermediate transfer member 7. A primary transfer roller 5*c* transfers a cyan toner image to the intermediate transfer member 7. A primary transfer roller 5*d* transfers a black toner image to the intermediate transfer member 7. As described above, a plurality of toner images, each having a different color, are transferred by being superimposed one over another onto the surface of the intermediate transfer member 7 to form a full-color toner image. For example, a blue toner image is formed by superimposing a cyan toner image and a magenta toner image one over another. The intermediate transfer member 7 rotates to convey a toner image to a secondary transfer unit 8.

A feeding unit 30 feeds a sheet stored in a sheet container to a conveying path. A conveying mechanism 31 has a plurality of conveying rollers and conveys a sheet P fed by the feeding unit 30 to registration rollers 32. The registration rollers 32 convey the sheet P to the secondary transfer unit 8.

The secondary transfer unit 8 includes an inner roller 18 and an outer roller 19. The inner roller 18 and the outer roller 19 convey the sheet P and the intermediate transfer member 7 while sandwiching them. Thus, a toner image is transferred to the sheet P. A fixing device 9 fixes the toner image onto the sheet P by applying heat and pressure to the sheet P and the toner image. A conveying mechanism 21 has a plurality of conveying rollers and conveys the sheet P on which the toner image has been fixed to the image reading apparatus 50.

The image reading apparatus 50 includes an inlet roller 51, a backing roller 52, an outlet roller 53, and an image sensor unit 55. The inlet roller 51 is a conveying roller for conveying the sheet P transferred from the conveying mechanism 21 further downstream. The backing roller 52 is a conveying roller that conveys the sheet P while keeping a distance between the image sensor unit 55 and the sheet P within a predetermined range. The outlet roller 53 is a conveying roller for discharging the sheet P to a discharge tray 60.

The image sensor unit 55 is, for example, a CIS (contact-type image sensor). However, the image sensor unit 55 may be another type of image sensor.

Image Sensor Unit

Figure 2:
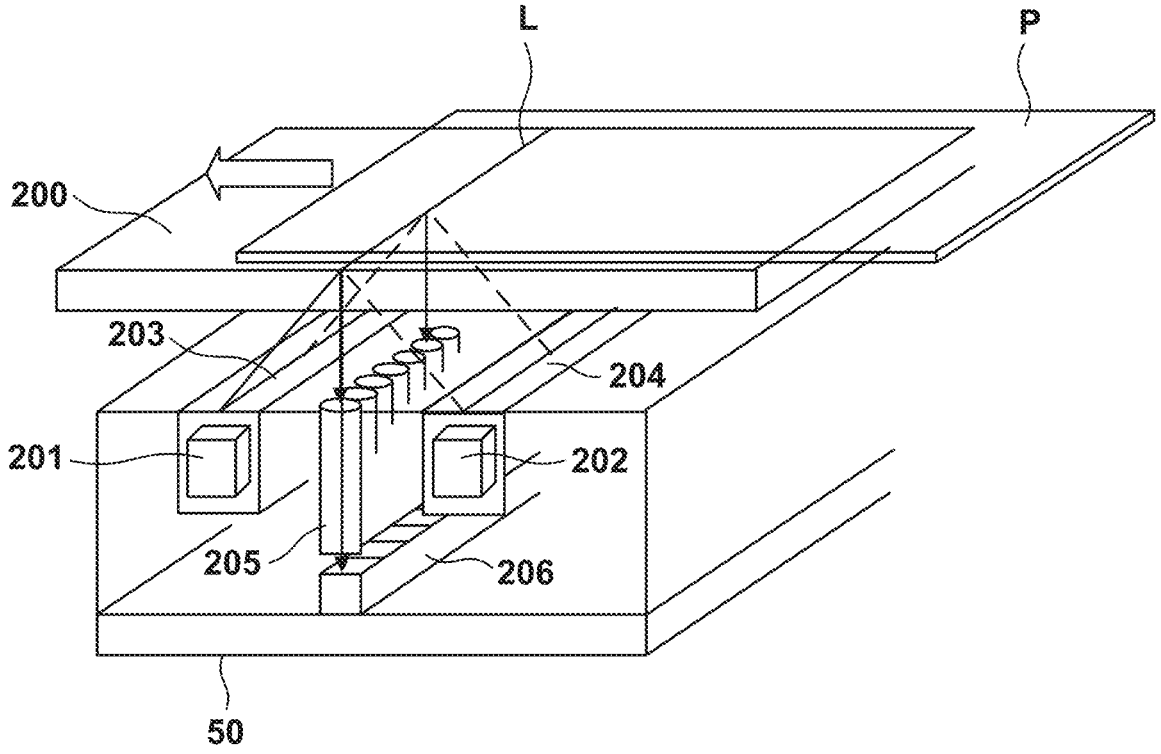
FIG. 2 is a diagram for explaining an image reading apparatus.

As illustrated in FIG. 2, the image sensor unit 55 reads an image formed on the sheet P that is conveyed over a document platen glass 200. L is a reading position L (a read line) of the image sensor unit 55. Light sources 201 and 202 are white LEDs or the like that output light for illuminating the sheet P. LED is an abbreviation for light emitting diode. A light guide 203 guides light outputted from the light source 201 to the reading position L. A light guide 204 guides light outputted from the light source 202 to the reading position L. This light reflects off of the surface or toner image of the sheet P passing through the reading position L and is directed toward a rod lens array 205. The rod lens array 205 is an image forming optical system for forming an image of the light on a sensor chip group 206. The sensor chip group 206 includes a plurality of photoelectric conversion elements, each having an R color filter, a G color filter, or a B color filter. The plurality of photoelectric conversion elements are arranged so as to extend in a direction (a main scanning direction) perpendicular to a conveyance direction (a sub-scanning direction) of the sheet P. Photoelectric conversion elements having the R color filter arranged in a row may be referred to as a line sensor for R. Photoelectric conversion elements having the G color filter arranged in a row may be referred to as a line sensor for G. Photoelectric conversion elements having the B color filter arranged in a row may be referred to as a line sensor for B. Each photoelectric conversion element outputs an analog image signal according to the amount of incident light (received light amount, brightness value). Here, signals outputted from the sensor chip group 206 may be referred to as R image signals, G image signals and B image signals.

Controller Board

Figure 3:
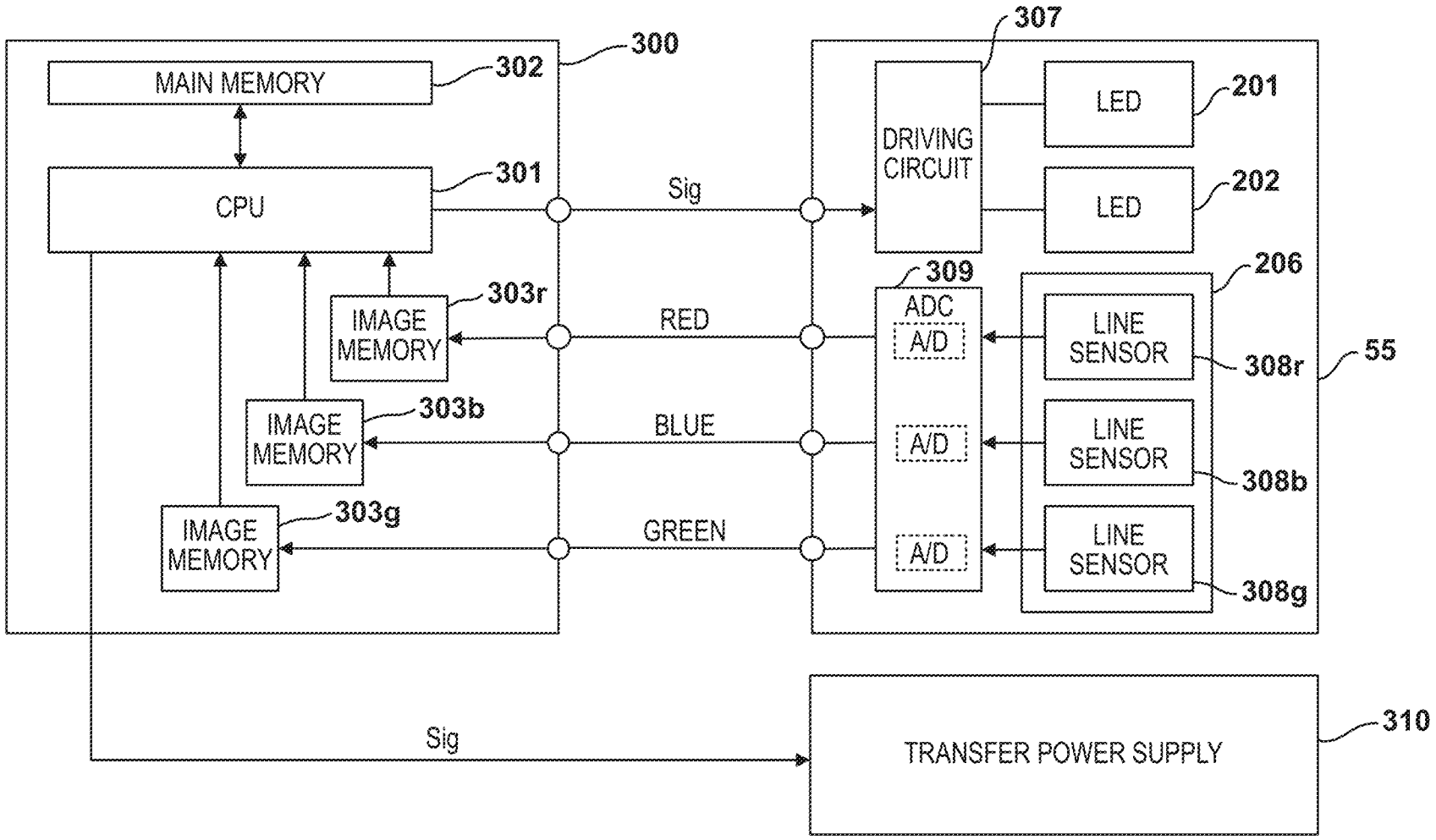
FIG. 3 is a diagram for explaining a controller.

As illustrated in FIG. 3, a controller board 300 includes a CPU 301, a main memory 302, and image memories 303*r*, 303*g*, and 303*b*. The CPU 301 controls a driving circuit 307 provided in the image sensor unit 55 and adjusts the amount of light to be emitted (the amount of light to be irradiated) from the light sources 201 and 202.

The sensor chip group 206 has line sensors 308*r*, 308*b*, and 308*g* corresponding to RGB. R image signals outputted from the line sensor 308*r* are converted into digital data (R image data) by an ADC 309. ADC is an abbreviation for analog-to-digital converter. The R image data is stored in the image memory 303*r*. B image signals outputted from the line sensor 308*b* are converted into digital data (B image data) by the ADC 309. The B image data is stored in the image memory 303*b*. G image signals outputted from the line sensor 308*g* are converted into digital data (G image data) by the ADC 309. The G image data is stored in the image memory 303*g*.

The CPU 301 determines a transfer condition (particularly, the transfer voltage) based on a result of reading a test image and sets it to a transfer power supply 310. The transfer power supply 310 generates a set transfer voltage and applies it to the outer roller 19. Incidentally, the rotational shaft of the inner roller 18 is made of metal and is grounded.

Method of Detecting Leading Ends of Toner Patterns

Figure 4A:
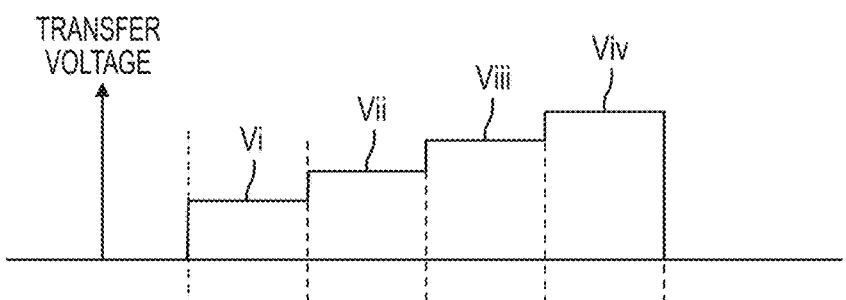
FIGS. 4A to 4C are diagrams for explaining a test image, transfer voltages, and a measurement result.
Figure 4B:
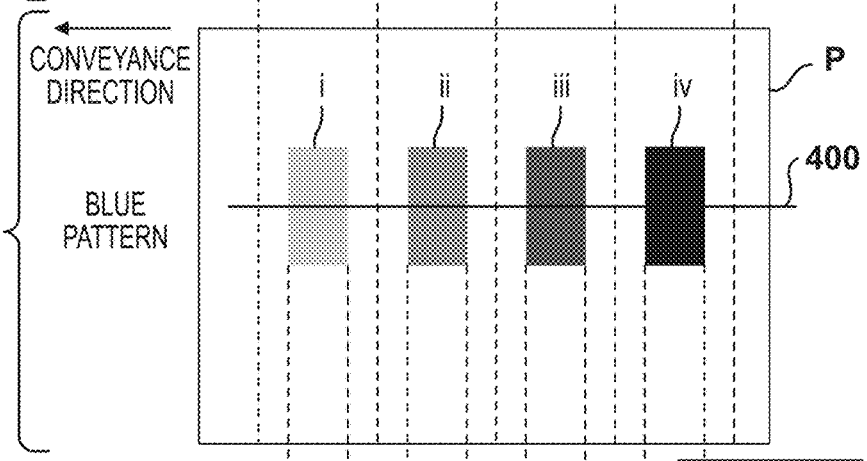
Figure 4C:
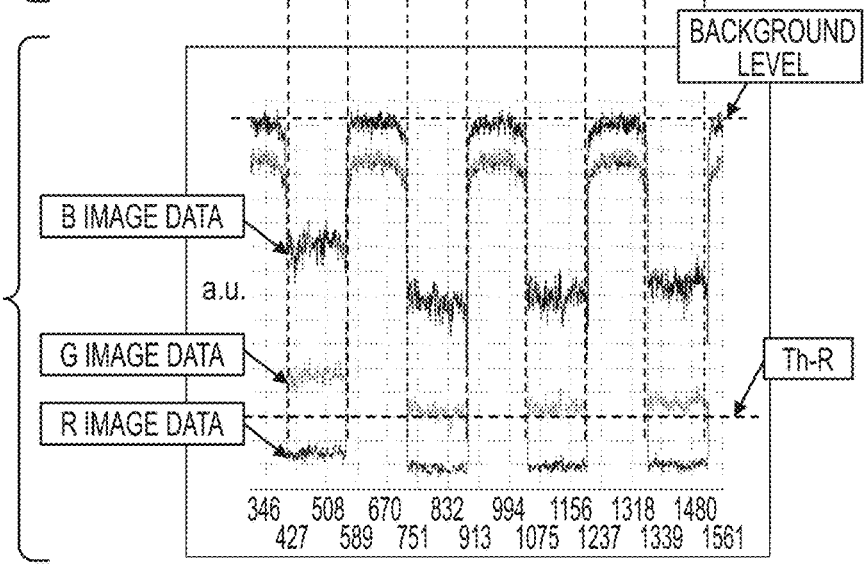

FIG. 4A illustrates changes in a transfer voltage. FIG. 4B illustrates a test image containing four blue patterns i to iv formed on the sheet P. FIG. 4C illustrates a result of reading the four blue patterns i to iv. The blue patterns i to iv are toner patterns (test patterns) generated by mixing colors of a cyan toner image and a magenta toner image. To find an appropriate transfer voltage, the four blue patterns i to iv are transferred to the sheet P respectively using different transfer voltages Vi to Viv. Original image data of the blue patterns i to iv is identical. However, because the transfer voltages Vi to Viv are different, densities of the blue patterns i to iv are also different. Incidentally, a density value of the original data of the blue patterns is a fixed value. For example, if the original data is 256 tones, a maximum value of 255 is selected. Incidentally, two or more blue patterns are likely sufficient for the number of blue patterns to be included in a test image.

The image sensor unit 55 reads the test image along a trajectory 400 as the sheet P is conveyed. As can be seen from FIG. 4B, the blue pattern i is the first blue pattern that arrives at the reading position L of the image sensor unit 55. Here, in order to reduce storage capacities of the image memories 303*r*, 303*g*, and 303*b*, it is necessary that a reading result of a blue pattern is at least stored in the image memories 303*r*, 303*g*, and 303*b*. To accomplish this, a trigger is required to store a result of reading a blue pattern. The CPU 301 determines or detects that a leading end portion of the blue pattern i has arrived at the reading position L based on an R image signal.

As illustrated in FIG. 4C, when B image data, G image data, and R image data obtained from the blue patterns i to iv are compared, it can be seen that the R image data is advantageous for detecting leading end portions. This is because the R image data is less sensitive to changes in densities of blue patterns compared to the G image data and the B image data. That is, even if densities of blue patterns change depending on changes in transfer voltage, changes in the R image data is small. Thus, the CPU 301 can accurately detect the arrival of leading end portions of the blue patterns i to iv by monitoring whether or not the R image data has fallen below a threshold Th-R.

The CPU 301 initiates sampling of a B image signal for the blue pattern i, triggered by the leading end portion of the blue pattern i arriving at the reading position L. Thus, n sampling values (B image data) are obtained for the blue pattern i. Similarly for the blue patterns ii to iv, sampling begins by the leading end portions being detected.

Functions of CPU

Figure 5:
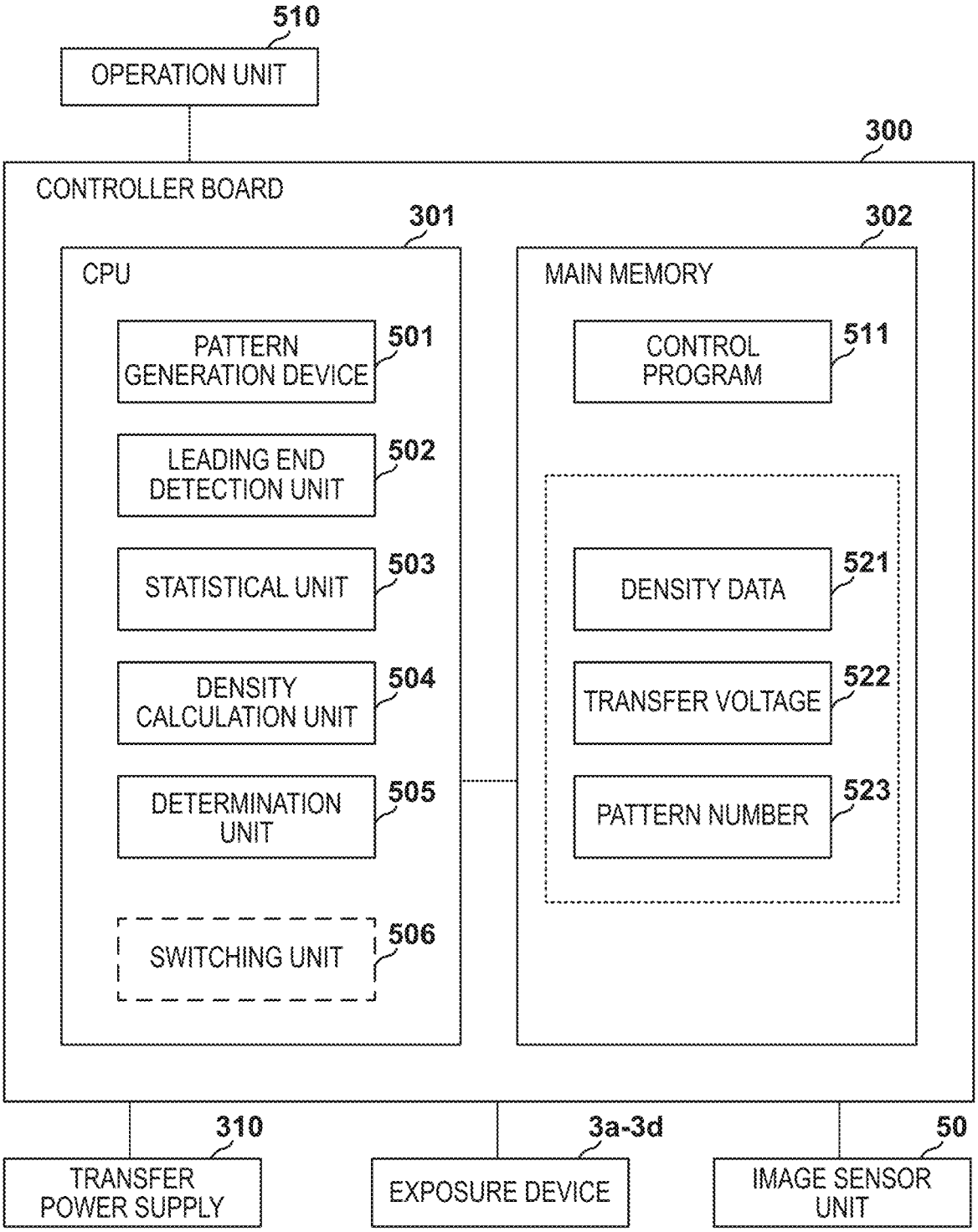
FIG. 5 is a diagram for explaining functions of a CPU.

FIG. 5 illustrates functions implemented by the CPU 301 executing a control program 511. A part of or all of these functions may be implemented by a hardware circuit such as an ASIC (Application Specific Integrated Circuit) or an FPGA (Field Programmable Gate Array).

A pattern generation device 501 generates original image data for forming a test image and supplies it to exposure devices 3*a* to 3*d*. A leading end detection unit 502 detects the arrival of leading end portions of blue patterns in a test image by monitoring the R image data. A statistical unit 503 executes statistical processing for sampling values (B image data) obtained from blue patterns to improve the accuracy of a measurement result. For example, the statistical unit 503 may calculate an average value of n−2 sampling values left after the maximum value and the minimum value have been excluded from n sampling values. An averaging process may be a weighted averaging process, a simple averaging process, or the like. A density calculation unit 504 calculates density data 521 of blue patterns based on statistic values of the B image data outputted from the statistical unit 503. Incidentally, the density calculation unit 504 may store pattern numbers (e.g., i to iv) which are identification information of the blue patterns i to iv, the density data 521, and the transfer voltages Vi to Viv in the main memory 302 in association with each other. A determination unit 505 determines an appropriate transfer voltage based on the density data 521. An appropriate transfer voltage is used to form, on the sheet P, a user image (original image) prepared by a user. The determination unit 505 may display, on a display apparatus of an operation unit 510, a message for querying the user as to which of the blue patterns i to iv they would like to select. The determination unit 505 may determine a transfer voltage associated with the identification information of the blue patterns i, ii, iii, or iv inputted from an input apparatus of the operation unit 510 to be an appropriate transfer voltage. In this case, the identification information of the blue patterns i to iv may also be printed on the sheet P. This makes it easier for the user to select an appropriate blue pattern and input its identification information. The determination unit 505 may determine a transfer voltage 522 associated with the density data 521 closest to a preset density value to be an appropriate transfer voltage. Alternatively, the determination unit 505 may determine an appropriate transfer voltage by performing interpolation calculation on the transfer voltage 522 associated with two pieces of density data 521 closest to the preset density value.

FIG. 5 illustrates a switching unit 506 by a broken line, indicating that this is an option. Details of the switching unit 506 are described in a second embodiment.

Flowchart

Figure 6:
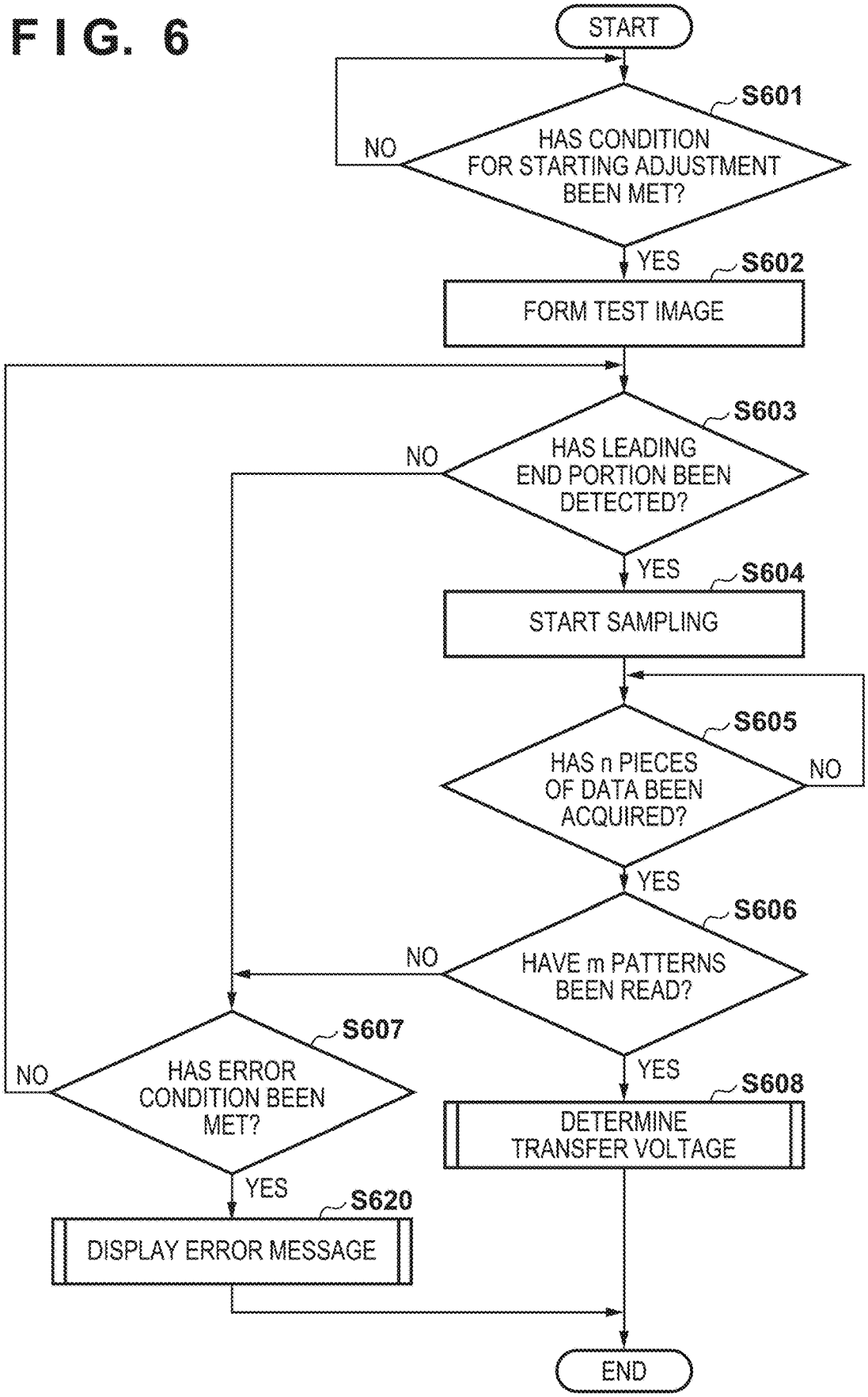
FIG. 6 is a flowchart illustrating a method for adjusting a transfer voltage.

FIG. 6 illustrates a method for adjusting a transfer voltage that the CPU 301 executes in accordance with the control program 511.

In step S601, the CPU 301 determines whether a condition for starting adjustment has been met. Here, the condition for starting adjustment is that an instruction to start adjustment has been inputted from the operation unit 510, that a process to register a new sheet P has been instructed, that a durability value (the number of times of image formation) of the intermediate transfer member 7 has reached the threshold value, or the like. When the condition for starting adjustment has been met, the CPU 301 advances the process to step S602.

In step S602, the CPU 301 forms a test image on the sheet P. The CPU 301 controls the image forming stations 10*a* to 10*d* to form the test image on the sheet P. As described above, the pattern generation device 501 generates image data to be a source of the test image and supplies the image data to the exposure devices 3*a* to 3*d*. Thus, the test image including the blue patterns i to iv is formed on the sheet P.

In step S603, the CPU 301 determines whether or not a leading end portion of a blue pattern has been detected based on R image data. This determination corresponds to determining whether a leading end portion of a blue pattern has arrived at the reading position L. R, G, and B image data acquired by the image sensor unit 55 when the sheet P passes through the reading position L are respectively stored in the image memories 303*r*, 303*g*, and 303*b*. The CPU 301 monitors the R image data, which is stored in the image memory 303*r*, for detecting leading end portions. When the R image data falls below the threshold Th-R, the CPU 301 determines that a leading end portion of a blue pattern has arrived at the reading position L and advances the process to step S604.

In step S604, the CPU 301 begins sampling B image data (a B image signal).

In step S605, the CPU 301 determines whether n pieces of data (sampling values) have been acquired by sampling. When n pieces of data have been acquired, the CPU 301 advances the process to step S606.

In step S606, the CPU 301 determines whether m patterns (e.g., 4 blue patterns) have been read. If m patterns have not been read, the CPU 301 advances the process to step S607. In step S607, the CPU 301 determines whether an error condition has been met. The error condition is that m patterns have not been read within a predetermined time, or that a trailing end of the sheet P has passed through the reading position L, or the like. If the error condition has not been met, the CPU 301 advances the process to step S603. If the error condition has been met, the CPU 301 advances the process to step S620. In step S620, the CPU 301 displays an error message on the operation unit 510 and terminates the method for adjusting the transfer voltage.

When it is determined in step S606 that m patterns have been read, the CPU 301 advances the process to step S608.

In step S608, the CPU 301 determines an appropriate transfer voltage based on a result of reading m blue patterns. As described above, for each of the m blue patterns, the CPU 301 calculates the density data 521 and stores the density data 521 in the main memory 302 in association with a pattern number and a transfer voltage. In addition, the CPU 301 determines an appropriate transfer voltage using any of the determination techniques described above.

FIG. 7 illustrates an example of pattern numbers (e.g., i to iv) which are identification information of the blue patterns i to iv, the density data 521, and the transfer voltages Vi to Viv. These pieces of data are associated with each other and stored in the main memory 302. The CPU 301 determines an appropriate transfer voltage according to this association.

According to the first embodiment, it is detected that a leading end portion of a blue pattern has arrived at the reading position L based on a result of reading red which is close to a color that is opposite to blue. The accuracy with which the blue pattern is read is improved since the accuracy with which a leading end portion of a blue pattern is read is improved, and further, the accuracy with which density is adjusted (transfer voltage is adjusted) is improved.

Second Embodiment

In the first embodiment, three image memories 303*r*, 303*g*, and 303*b* are used. In the second embodiment, a structure for further reducing image memory is described.

Figure 8:
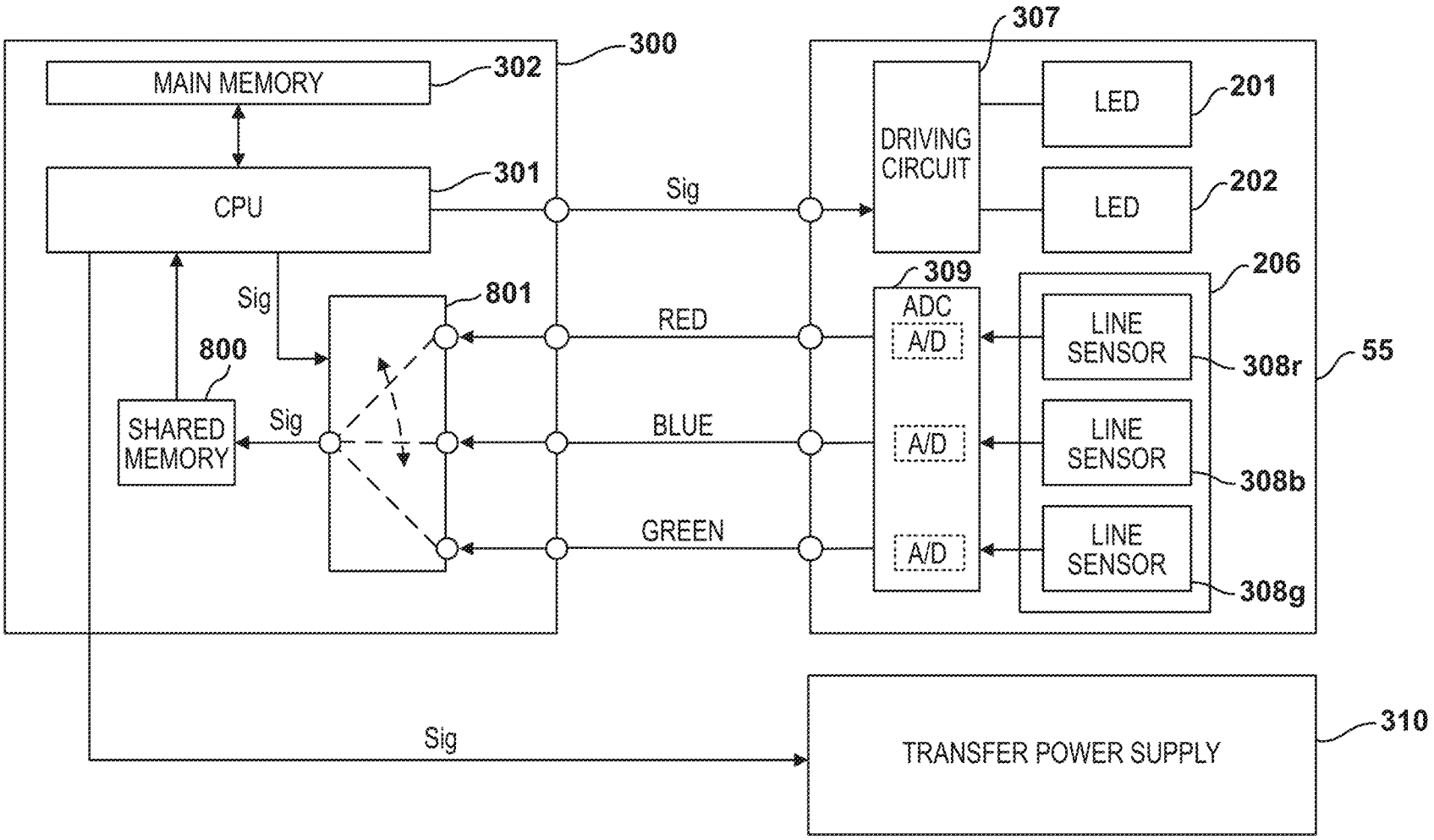
FIG. 8 is a diagram for explaining the controller.

FIG. 8 illustrates the controller board 300 of the second embodiment. Compared to FIG. 3, the image memories 303*r*, 303*g*, and 303*b* have been replaced with a shared memory 800 and a data selection circuit 801 in FIG. 8. The storage capacity of the shared memory 800 is equivalent to the storage capacity of one of the three image memories 303*r*, 303*g*, and 303*b*. Therefore, the CPU 301 (switching unit 506) controls the data selection circuit 801 to select image data to be stored in the shared memory 800. For example, in a period for detecting the leading end portions of the blue patterns described above, the CPU 301 (switching unit 506) controls the data selection circuit 801 so that the R image data is stored in the shared memory 800. The CPU 301 detects the leading end portions of the blue patterns based on the R image data stored in the shared memory 800.

In a period for sampling the blue patterns, the CPU 301 (switching unit 506) controls the data selection circuit 801 so that the B image data is stored in the shared memory 800.

Thus, switching from the R image data to the B image data is performed, when it is determined Yes in step S603, for example. Switching from the B image data to the R image data is performed, when it is determined No in step S606, for example. This reduces the size of the image memory for storing the image data.

Technical Concept Derived from Embodiments

As illustrated in FIG. 1, the image forming station 10*b* is an example of a first image forming unit that forms an image using magenta toner. The image forming station 10c is an example of a second image forming unit that forms an image using cyan toner. The intermediate transfer member 7 is an example of an intermediate transfer member to which a magenta image formed by the first image forming unit and a cyan image formed by the second image forming unit are transferred. The secondary transfer unit 8 is an example of a transfer unit to which a transfer voltage is applied to transfer, to a sheet, an image transferred to the intermediate transfer member. The fixing device 9 is an example of a fixing unit for fixing an image to a sheet. The backing roller 52 is an example of a conveying unit for conveying a sheet. The image reading apparatus 50 is an example of an image reading unit that reads a test image on a sheet conveyed by the conveying unit. The CPU 301 is an example of a control unit that controls a transfer voltage based on a result of reading by the image reading unit. The image reading unit receives light reflected off of a test image and has an R element that outputs an output value corresponding to light reflected off of an R component, a G element that outputs an output value corresponding to light reflected off of a G component, and a B element that outputs an output value corresponding to light reflected off of a B component. A test image has blue patterns generated by superimposing a magenta image and a cyan image one over another. By controlling the transfer voltage to change as a sheet is conveyed, blue patterns are transferred to the sheet using a plurality of different transfer voltages. That is, the transfer voltage changes in parallel with the sheet being conveyed. For example, the transfer voltage may change in steps. The CPU 301 determines a condition for acquiring the output value outputted from the B element based on the output value outputted from the R element. Furthermore, the CPU 301 controls the transfer voltage based on a result of acquiring the output signal outputted from the B element based on the acquisition condition. This suppresses errors in reading a test image used to adjust the transfer voltage.

A plurality of different transfer voltages may include a first transfer voltage and a second transfer voltage larger than the first transfer voltage. As illustrated in FIG. 4A, a first blue pattern is transferred based on the first transfer voltage. A second blue pattern is transferred based on the second transfer voltage. As illustrated in FIG. 4B, the first blue pattern may pass the reading position L of the image reading unit prior to the second blue pattern in a direction in which a sheet is conveyed.

As illustrated in FIG. 1, a photosensitive drum 1 is an example of a photosensitive member. A primary charging device 2 is an example of a charging unit that uniformly charges the photosensitive member. An exposure device 3 is an example of an exposure unit that irradiates the photosensitive member with light to form an electrostatic latent image. A developing device 4 is an example of a developing unit that develops the electrostatic latent image formed on the photosensitive member with toner to form a toner image. A primary transfer roller 5 is an example of a primary transfer unit that transfers the toner image to the intermediate transfer member. The secondary transfer unit 8 is an example of a secondary transfer unit that transfers the toner image from the intermediate transfer member (e.g., the intermediate transfer belt) to the sheet P. The transfer power supply 310 is an example of a power supply unit that supplies a transfer voltage to the secondary transfer unit. The controller board 300 and the CPU 301 are examples of a control unit that controls the transfer voltage. The backing roller 52 is an example of a conveying unit for conveying the sheet P. The image sensor unit 55 is an example of an image reading unit that reads a test image transferred to the sheet P conveyed by the conveying unit. The image sensor unit 55 is an example of an RGB-type image reading unit that reads a test image for adjusting the transfer voltage. The line sensor 308*r* is an example of an R element that receives light reflected off of the test image and outputs a signal of an R component. The line sensor 308*g* is an example of a G element that receives light reflected off of the test image and outputs a signal of a G component. The line sensor 308*b* is an example of a B element that receives light reflected off of the test image and outputs a signal of a B component. As illustrated in FIG. 4B, the test image has a plurality of blue patterns, each of which is generated by mixing colors of a magenta toner and a cyan toner. As illustrated in FIG. 4A, the plurality of blue patterns may be respectively transferred to a sheet using different transfer voltages. The CPU 301 determines whether or not any blue pattern of the plurality of blue patterns has arrived at the reading position L of the image reading unit based on a level of a signal outputted from the R element. The G element may be used in place of the R element. When any blue pattern arrives at the reading position L of the image reading unit, the CPU 301 acquires a signal outputted from the B element and adjusts the transfer voltage according to the acquired signal outputted from the B element. Thus, by using the R element or the G element, the arrival of a blue test image is detected with high accuracy. As a result, since the accuracy with which a blue test image is read is improved, the transfer voltage is adjusted with high accuracy.

The CPU 301 may acquire density data based on the signal outputted from the B element for each of the plurality of blue patterns. For each of the plurality of blue patterns, the CPU 301 associates and then stores, in the storage unit, the acquired density data with a transfer voltage applied for the blue pattern that has been read to acquire that density data.

The operation unit 510 is an example of an input unit that inputs identification information (e.g., pattern number) given to each of the plurality of blue patterns formed on the sheet P. The CPU 301 may set a power supply unit so as to supply the secondary transfer unit with a transfer voltage corresponding to the identification information inputted from the input unit among the plurality of transfer voltages stored in the storage unit.

The CPU 301 may select the density data close to predetermined density data among a plurality of density data stored in the storage unit and read, from the storage unit, the transfer voltage associated with the selected density data. The CPU 301 may set the power supply unit to provide the secondary transfer unit with the read transfer voltage.

The ADC 309 is an example of a first conversion unit for converting an analog signal outputted from the R element into digital data. The image memory 303*r* is an example of a first memory that stores R data, which is digital data outputted from the first conversion unit. The ADC 309 is an example of a second conversion unit for converting an analog signal outputted from the B element into digital data. The image memory 303*b* is an example of a second memory that stores B data, which is digital data outputted from the second conversion unit. The CPU 301 detects that one of the blue patterns has arrived at the reading position L of the image reading unit based on the R data stored in the first memory. The CPU 301 calculates density data based on the B data stored in the second memory.

The data selection circuit 801 is an example of a selection unit for selecting the R data which is digital data outputted from the first conversion unit or the B data which is digital data outputted from the second conversion unit. The shared memory 800 is an example of shared memory that stores digital data selected by the selection unit. The CPU 301 detects that one of the blue patterns has arrived at the reading position L of the image reading unit based on the R data stored in the shared memory. The CPU 301 calculates density data based on the B data stored in the shared memory.

The data selection circuit 801 selects the R data in a detection period for detecting a leading end portion. The detection period is a period from the start of detection until the digital data stored in the shared memory becomes data corresponding to the arrival of any blue pattern at the reading position L of the image reading unit. The data selection circuit 801 selects the B data when a condition for starting reading has been met. The condition for starting reading is that the digital data stored in the shared memory becomes data corresponding to the arrival of any blue pattern at the reading position L of the image reading unit.

The CPU 301 may acquire a plurality of sampling values by sampling a signal outputted from the B element for each of the plurality of blue patterns. The CPU 301 may acquire density data by statistically processing a plurality of sampling values for each blue pattern.

For each blue pattern, the CPU 301 may obtain sampling values left after the maximum value and the minimum value has been excluded from the plurality of sampling values. The CPU 301 may acquire density data by statistically processing the remaining sampling values. Since this removes noise, the accuracy with which the density data is acquired is improved.

The developing devices 4*a* to 4c are examples of developing units that form a yellow image using yellow toner, form a magenta image using magenta toner, and form a cyan image using cyan toner. The intermediate transfer member 7 is an example of an intermediate transfer member and an image bearing member to which a yellow image, a magenta image, and a cyan image are transferred. The inner roller 18 and the outer roller 19 are examples of transfer rollers that transfer an image on the intermediate transfer member to a sheet when a transfer voltage is applied. The fixing device 9 is an example of a fixing unit for fixing an image to a sheet. The image forming stations 10*a* to 10*d* are examples of an image forming unit that forms an image on a sheet or an image on the image bearing member. The image forming unit may include a first developing device configured to develop a yellow image by using yellow toner, a second developing device configured to develop a magenta image by using magenta toner, and a third developing device configured to develop a cyan image by using cyan toner.

The inlet roller 51, the backing roller 52, and the outlet roller 53 are examples of conveying rollers for conveying a sheet to which an image has been fixed.

The image sensor unit 55 is an example of a color sensor that reads an image of a sheet while the sheet is being conveyed by the conveying roller. As described in connection with FIG. 2, the color sensor includes a red color filter, a blue color filter, and a green color filter.

The controller board 300 and the CPU 301 are examples of a controller. The controller controls the image forming unit to form test images of a color of the same type as a first color among red, blue, and green on a sheet using toner of a second color among yellow, magenta, and cyan, and toner of a third color among yellow, magenta, and cyan. The controller may control the transfer unit to transfer a first test image included in the test images based on a first transfer voltage, and transfer a second test image included in the test images based on a second transfer voltage different from the first transfer voltage. The controller may control the fixing unit to fix the test images on a sheet. The controller may control the color sensor to read the image of the sheet having the test images thereon. The controller may determine sampling timings for the test images on the sheet based on an output signal related to the first test image on the sheet outputted from the color sensor using a color filter of a fourth color among red, blue, and green. The controller may acquire a result of reading the test images based on a reading result of the test images on the sheet by the color sensor using a color filter of the first color, and the sampling timings. The controller may determine the transfer voltage based on the result of reading the test images.

For example, the first color is blue, the second color is magenta, and the third color is cyan.

For example, the first color is blue, the second color is magenta, the third color is cyan, and the fourth color is red.

For example, the first color is blue, the second color is magenta, the third color is cyan, and the fourth color is green.

For example, the first color is green, the second color is yellow, and the third color is cyan.

For example, the first color is green, the second color is yellow, the third color is cyan, and the fourth color is red.

For example, the first color is green, the second color is yellow, the third color is cyan, and the fourth color is blue.

For example, the first color is red, the second color is yellow, and the third color is magenta.

For example, the first color is red, the second color is yellow, the third color is magenta, and the fourth color is blue.

For example, the first color is red, the second color is yellow, the third color is magenta, and the fourth color is green.

For example, the color sensor may include a first line sensor that receives light through a red color filter, a second line sensor that receives light through a blue color filter, and a third line sensor that receives light through a green color filter.

For example, the controller may determine a sampling timing based on a result of comparing a value of the first output signal and a threshold value. The color sensor reads image of the sheet after the test images are fixed on the sheet. A position of the first test image on the sheet in a conveyance direction is different from a position of the second test image on the sheet in the conveyance direction.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-017742, filed Feb. 5, 2021, which is hereby incorporated by reference herein in its entirety.

What is claimed is:

1. An image forming apparatus comprising:

an image bearing member;

an image forming unit configured to form an image on the image bearing member, the image forming unit including:

a first developing device configured to develop a yellow image by using yellow toner;

a second developing device configured to develop a magenta image by using magenta toner; and a third developing device configured to develop a cyan image by using cyan toner;

a transfer unit configured to transfer the image on the image bearing member to a sheet based on a transfer voltage;

a fixing unit configured to fix the image on the sheet;

a color sensor configured to read the image on the sheet while the sheet is being conveyed, the color sensor having a red color filter, a blue color filter, and a green color filter; and a controller configured to:

control the image forming unit to form test images of a color of the same type as a first color among red, blue, and green using toner of a second color among yellow, magenta, and cyan, and toner of a third color among yellow, magenta, and cyan;

control the transfer unit to transfer a first test image included in the test images based on a first transfer voltage, and transfer a second test image included in the test images based on a second transfer voltage different from the first transfer voltage;

control the fixing unit to fix the test images on a sheet;

control the color sensor to read image on the sheet having the test images thereon;

determine sampling timings for the test images on the sheet based on an output signal related to the first test image on the sheet outputted from the color sensor using a color filter of a fourth color among red, blue, and green;

acquire a result of reading the test images based on a reading result of the test images on the sheet by the color sensor using a color filter of the first color, and the sampling timings; and determine the transfer voltage based on the result of reading the test images.

2. The image forming apparatus according to claim 1, wherein the first color is blue, the second color is magenta, and the third color is cyan.

3. The image forming apparatus according to claim 1, wherein the first color is blue, the second color is magenta, the third color is cyan, and the fourth color is red.

4. The image forming apparatus according to claim 1, wherein the first color is blue, the second color is magenta, the third color is cyan, and the fourth color is green.

5. The image forming apparatus according to claim 1, wherein the first color is green, the second color is yellow, and the third color is cyan.

6. The image forming apparatus according to claim 1, wherein the first color is green, the second color is yellow, the third color is cyan, and the fourth color is red.

7. The image forming apparatus according to claim 1, wherein the first color is green, the second color is yellow, the third color is cyan, and the fourth color is blue.

8. The image forming apparatus according to claim 1, wherein the first color is red, the second color is yellow, and the third color is magenta.

9. The image forming apparatus according to claim 1, wherein the first color is red, the second color is yellow, the third color is magenta, and the fourth color is blue.

10. The image forming apparatus according to claim 1, wherein the first color is red, the second color is yellow, the third color is magenta, and the fourth color is green.

11. The image forming apparatus according to claim 1, wherein the color sensor includes a first line sensor that receives light through a red color filter, a second line sensor that receives light through a blue color filter, and a third line sensor that receives light through a green color filter.

12. The image forming apparatus according to claim 1, wherein the controller determines a sampling timing based on a result of comparing a value of the output signal related to the first test image and a threshold value.

13. The image forming apparatus according to claim 1, wherein the color sensor reads image on the sheet after the test images are fixed on the sheet.

14. The image forming apparatus according to claim 1, wherein a position of the first test image on the sheet in a conveyance direction is different from a position of the second test image on the sheet in the conveyance direction.

* * * * *